US007108048B2

(12) United States Patent
Brummayer et al.

(10) Patent No.: US 7,108,048 B2
(45) Date of Patent: Sep. 19, 2006

(54) TUNDISH AND METHOD FOR PRODUCTION OF A METAL STRIP OF HIGH PURITY

(75) Inventors: Markus Brummayer, Aschach/Donau (AT); Gerald Eckerstorfer, Linz (AT); Gerald Hohenbichler, Kronstorf (AT); Karl Moerwald, St. Florian (AT)

(73) Assignee: Voest-Alpine Industrieanlagenbau GmbH & Co., (AT)

( * ) Notice: Subject to any disclaimer, the term of this patent is extended or adjusted under 35 U.S.C. 154(b) by 45 days.

(21) Appl. No.: 10/498,797

(22) PCT Filed: Dec. 4, 2002

(86) PCT No.: PCT/EP02/13687

§ 371 (c)(1),
(2), (4) Date: Jul. 14, 2004

(87) PCT Pub. No.: WO03/051560

PCT Pub. Date: Jun. 26, 2003

(65) Prior Publication Data

US 2005/0067134 A1 Mar. 31, 2005

(30) Foreign Application Priority Data

Dec. 14, 2001 (AT) ..... A 1961/2001

(51) Int. Cl.
*B22D 11/10* (2006.01)
*B22D 11/103* (2006.01)
*B22D 41/08* (2006.01)

(52) U.S. Cl. ..... 164/488; 164/437; 222/591

(58) Field of Classification Search ..... 164/437–440, 164/335–337; 222/590–607
See application file for complete search history.

(56) References Cited

U.S. PATENT DOCUMENTS 3,333,746 A 8/1967 Cope et al.
4,715,586 A 12/1987 Schmidt et al.

FOREIGN PATENT DOCUMENTS

DE 20 10 743 11/1971

(Continued)

OTHER PUBLICATIONS

International Search Report dated Aug. 7, 2003.

(Continued)

*Primary Examiner*—Kuang Y. Lin
(74) *Attorney, Agent, or Firm*—Ostrolenk, Faber, Gerb & Soffen, LLP

(57) ABSTRACT

To achieve the highest possible separation rate for foreign particles in a tundish combined, at the same time, with a minimized level of inclusions, the refractory-lined interior space of the tundish, as a function of an operating bath level (h), satisfies the condition that a dimensionless ratio (κ) of the refractory-lined surface area ($A_{ref}$) to the filling volume (V) which is delimited by this refractory-lined surface area and the bath-level-dependent exposed surface area ($A_{Top}$) and results from the relationship $$\kappa = \frac{A_{ref}}{(V)^{\frac{2}{3}}}$$

be between 3.83 and 4.39.

34 Claims, 5 Drawing Sheets

FOREIGN PATENT DOCUMENTS

| | | |
|---|---|---|
| DE | 3 514 539 | 11/1985 |
| EP | 0 376 523 | 7/1990 |
| EP | 0 804 306 | 7/1990 |
| EP | 0 533 943 | 3/1993 |
| JP | 57 115949 | 7/1982 |
| WO | WO 01/61059 | 8/2001 |

OTHER PUBLICATIONS

English language equivalents of German Patent No. 3 514 539=. U.S. 4 632,668 dated Dec. 1986 Wilson, Jr. et al. and Divisional U.S. 4,739,972 dated Apr. 1988 Podrini.

TUNDISH AND METHOD FOR PRODUCTION OF A METAL STRIP OF HIGH PURITY

BACKGROUND OF THE INVENTION

The invention relates to a tundish having a refractory lining for producing and transferring high-purity metal melt from a casting ladle into the permanent mold of a continuous casting installation, and to a process for producing a high-purity metal strand using a continuous casting installation.

During the continuous casting of metal strands, in particular during the continuous casting of steel, a tundish is usually fitted between the casting ladle and the continuous casting permanent mold, in order to compensate for fluctuations in the supply of melt and in the rate at which the metal strand is drawn off from the continuous-casting installation. Especially in the case of sequence casting, it is necessary to store a sufficient quantity of metal melt in the tundish to span the time required to change the ladle.

The melt is usually transferred from the tundish to the permanent mold of a continuous casting installation through an outflow opening in the tundish base, which is assigned a controllable closure member, such as a slide or a stopper, and also through a submerged casting pipe or a casting nozzle. The permanent mold may be designed in a very wide range of ways, for example it may be an oscillating tube or plate mold, a mold formed by a single casting roll or by two interacting casting rolls and side plates, or a mold formed by revolving belts or tracks.

In the case of multi-strand casting installations, this tundish is designed as a distributor vessel and, via a plurality of melt outlets, supplies a plurality of continuous casting permanent molds arranged next to one another. V-shaped distributor vessels are known for two-strand casting installations.

Furthermore, the tundish is usually used to calm the metal melt which flows in from the casting ladle and is supposed to allow slag particles and other nonmetallic inclusions to be separated out during the residence time of the metal melt in the tundish. To ensure that this is achieved to a sufficient extent, the flow properties of the metal melt are usually deliberately influenced by flow-guiding internal fittings in the tundish. Trough-like tundishes formed in this way are already known, for example from EP-B 804 306 and EP-A 376 523.

If the flow and temperature characteristics in a trough-shaped tundish, as has been used for decades in conventional steelmaking processes and continuous casting installations, are considered, liquid steel is introduced from the casting ladle, via a shroud, into a manifold vessel or tundish. The induced steel jet flows toward the tundish base, where it strikes the flat base of the tundish or a flow-diversion device, which diverts the jet of liquid toward the bath level surface and extracts kinetic energy through dissipation. In the inlet region, the flow generally returns to the bath level surface, migrates along the latter and is submerged again along the narrow back wall and along the side walls of the trough-shaped tundish. As a result, depending on the shape of the tundish, substantially two oppositely rotating recirculation rolls (upward flow in the longitudinal-center section), which migrate in the direction of the outlet opening, are induced. The jet temperature decreases in the direction of the outlet opening as a result of heat losses via the side walls and the bath level surface, with the temperature loss between the feed location and outlet location being dependent on the throughput.

The foreign substances in the metal melt, which are to be separated out as efficiently as possible, originate firstly from the steelmaking process, and are flushed out of the casting ladle into the tundish when the metal melt is transferred. Secondly, foreign substances are also introduced into the metal melt in the tundish itself. These foreign substances originate from the refractory lining material of the tundish and/or from the liquid steel covering slag which is generally used, and are abraded and suspended firstly through mechanical erosion as a result of wall shear stresses or through chemical erosion resulting from reoxidation processes. Furthermore, inclusions of slag are formed through resuspension on account of high bath level velocities and increased surface turbulence.

Therefore, it is an object of the present invention to avoid the drawbacks which have been outlined and to propose a tundish and a process for producing a metal strand in which the reintroduction of particles into the metal melt within the tundish is minimized and overall the maximum possible separation rate for all the inclusions which are present in the metal melt is achieved, so that a melt which is as pure as possible is fed to the permanent mold.

SUMMARY OF THE INVENTION

This object is achieved, in a tundish according to the invention with a refractory lining, by virtue of the fact that a refractory-lined interior space of the tundish, as a function of an operating bath level (h), satisfies the condition that a dimensionless ratio (κ) of the refractory-lined surface area ($A_{ref}$) which is wetted by the metal melt to the filling volume (V) which is delimited by this refractory-lined surface area and the bath-level-dependent exposed surface area ($A_{Top}$) and results from the relationship $$\kappa = \frac{A_{ref}}{(V)^{\frac{2}{3}}}$$

be between 3.83 and 4.39.

It is preferable for these values for the dimensionless ratio κ to be between 3.83 and 4.2.

The dimensionless ratio κ, which defines a volumetric wetting level, demonstrates that the contact surface area between lining and metal melt should be minimized in relation to the quantity of metal melt stored in the tundish. At the same time, however, the fact that a suitable separation surface area for maximum particle separation is required should not be disregarded. Analyses of a very wide range of tundish shapes have revealed that optimum particle separation rates can be achieved with tundish shapes in which the ratio κ is within the claimed range. The range limits indicated result from the geometry of a hemisphere $$\left(\kappa = \frac{2 \cdot \pi}{\left(\frac{2}{3}\pi\right)^{2/3}} \cong 3.83\right)$$

and the geometry of an upright cylinder, in which the radius of the circular base area is equal to the height of the cylinder ($\kappa = 3\pi^{1/3} \cong 4.39$).

A high particle separation rate is established if, in addition, the refractory-lined interior space of the tundish, as a function of the operating bath level (h), satisfies the condition that the ratio (ζ) of the exposed surface area ($A_{Top}$) to the refractory-lined surface area ($A_{ref}$) wetted by the metal melt be between 0.45 and 1.0. The dimensionless ratio ζ, which places the exposed surface area, which acts as a particle separation surface, in a relationship to the wetted lining surface area, which acts as a particle-generating surface, shows that within the preferred range the contradictory effects balance one another out. An expedient particle separation rate is established with a ratio ζ of between 0.5 and 0.8.

The κ and ζ values determined above do not take account of any additional tundish internal fittings, such as flow diverters, weirs, etc.

To ensure a high particle separation rate, it is expedient for the operating bath level to be between 0.5 m and 1.5 m.

The demand for a high level of particle separation from the metal melt in the tundish is reliably ensured, in the case of sequence casting, even during the ladle change phase if the filling volume of the interior space of the tundish contains at least 5 times, preferably at least 7 times, the quantity of metal melt which is cast each minute in normal operation.

To realize expedient separation rates, the filling volume of the interior space of the tundish is at least 0.75 $m^3$, but preferably at least 1.0 $m^3$. Even these volumes ensure a sufficient residence time for the melt in the tundish at casting rates of from 60 to 100 t of steel per hour. Higher minimum volumes are recommended for higher casting rates.

The possible embodiments of a tundish which are claimed in accordance with the invention combine the following contradictary requirements:

- a maximum particle separation rate, which implies the largest possible separation surface area or bath level surface area,
- a minimum area of refractory material which is wetted with aggressive metal melt, minimizing the formation of additional inclusions,
- minimized bath level velocities and surface turbulence, reducing the formation of slag inclusions,
- a minimum lowering of the bath level during non-steady-state operating modes, such as for example sequence casting,
- a reduction in the heat losses compared to conventional tundishes in accordance with the prior art,
- allows short-circuit operation, i.e. the majority of the metal melt flows through the tundish over the shortest possible path between melt feed and outlet opening.

Preferred forms of the tundish result if the refractory-lined interior space of the tundish is substantially formed by a generatrix which rotates about a vertical tundish axis. This produces rotationally symmetrical vessel interior spaces.

The optimum shape, which for a given tundish volume has a maximum surface area for separation of inclusions into the bath-covering slag and, at the same time, forms the smallest possible surface which is wetted by aggressive metal melt for mechanical and chemical erosion, is formed by a hemisphere or a segment of a hemisphere. For the hemisphere segment shape, it is possible to give a generally applicable relationship for the theoretically ideal area ratio of bath level surface area to wetted refractory lining:

$$\zeta = \frac{1}{1+\left(\frac{h}{R}\right)^2}$$

where $h/R \leqq 1$ in which h corresponds to the operating bath level and R corresponds to the bath level radius. If h/R=1, a hemisphere geometry is present and ζ is 0.5. If the h/R ratio is reduced, for example, to 0.6, for the same distributor volume the ratio of the bath level surface area to the lining surface area wetted with liquid steel is increased to ζ=0.73. Therefore, if a sphere segment geometry (h/R<1) is selected for a defined tundish volume, an additional increase in the purifying action is likely.

Further possible embodiments result if the refractory-lined interior space of the tundish is substantially formed by a generatrix which rotates about a vertical tundish axis at a fluctuating, preferably harmonically pulsating distance (r) from the vertical tundish axis. Therefore, cross sections which are elliptical in the direction which is normal with respect to the vertical tundish axis, but also cross sections with any other desired external contour, for example a square cross section with large rounding radii, or polygonal cross sections, are possible.

Suitable forms of tundish result if the tundish, at least in sections, has an interior space which is in the shape of a hemisphere, a truncated cone, a paraboloid of revolution or a cylinder and in this case the cross section of the tundish interior space, in a section plane taken normally to the vertical tundish axis, at least in sections, is circular or elliptical in form.

To allow optimum use to be made of the entire interior space of the tundish for particle separation, there is a submerged pipe which projects into the tundish in order to supply the melt, and a flow diverter is arranged on the tundish base beneath the submerged pipe and the outlet opening is arranged at a location on the tundish base which is spaced apart from the flow diverter by at least half the diameter of the base.

In particular if the tundish according to the invention is to be used to supply a plurality of strands, arranged next to one another, in a continuous casting installation with melt and the melt is therefore to be distributed between a plurality of permanent molds, the tundish comprises a melt feed tank and at least one melt discharge tank, with each melt discharge tank being separated from the melt feed tank by a transfer passage, preferably an overflow, and each melt discharge tank delimiting an interior space of the tundish. This type of tundish, in which the melt flows through two tanks arranged in series, means that the region where the melt is supplied from the casting ladle is separated from the region where the melt is discharged into the permanent mold not only spatially but also structurally, and therefore allows additional continuity to be achieved in the flow characteristics. The connecting region between melt feed tank and melt discharge tank can be produced by an overflow or by a transfer passage, which may also be arranged below the bath level. The geometric conditions described above relating to the configuration of the interior space must be satisfied at least by the melt discharge tank. An additional contribution is made to reducing the amount of foreign substances introduced from the lining of the tundish if the melt feed tank delimits an interior space of the tundish and satisfies the conditions of the dimensionless ratio (κ) and if appropriate also the dimensionless ratio (ζ). The melt feed tank is assigned a flow diverter, and the melt discharge tank is assigned at least one outlet opening.

To allow simple manipulation of the tundish according to the invention, in particular for it to be prepared for casting and positioned accurately above the permanent mold opening, the tundish is supported on a distributor carriage, which preferably has lifting and/or tilting devices, has a movement drive and is designed such that it can be displaced on a movement path between an operating position and a waiting position.

The advantages and effects described are also produced in a process for producing a high-purity metal strand, preferably a steel strand using a continuous casting installation, in which metal melt is passed from a casting ladle into a tundish and from the latter into a continuous-casting permanent mold, a melt volume (V) of a metal melt contained in the refractory-lined interior space of the tundish being set in such a way, as a function of the respective operating bath level, that a dimensionless ratio (κ) of the contact surface area ($A_{ref}$) formed by the metal melt to the melt volume (V) which is delimited by this contact surface area ($A_{ref}$) formed by the metal melt and the bath-level-dependent exposed surface area ($A_{Top}$) and which results from the relationship $$\kappa = \frac{A_{ref}}{(V)^{\frac{2}{3}}}$$

is between 3.83 and 4.39. It is preferable for this dimensionless ratio (κ) to be between 3.83 and 4.2.

A high degree of purity in the melt for the subsequent casting process is achieved if, in addition, a melt volume (V) of the metal melt contained in the interior space is set in such a way that the ratio (ζ) of the exposed surface area ($A_{Top}$) formed by the metal melt to the contact surface area ($A_{ref}$) formed by the metal melt is between 0.45 and 1.0, preferably between 0.5 and 0.8.

To realize favorable separation rates and therefore a high purity of the cast product, the operating bath level is set to between 0.5 m and 1.5 m. The melt volume which is located in the interior space of the tundish is in this case set to at least 0.75 $m^3$, preferably at least 1.0 $m^3$. The demands imposed with regard to a high level of particle separation are reliably ensured, in the case of sequence casting, even while the casting ladle is being changed, if the melt volume is set to at least 5 times, preferably at least 7 times, the quantity of metal melt which is cast each minute during normal operation.

In this case, the metal melt substantially takes up an interior space formed by a generatrix which rotates about a vertical tundish axis. Alternatively, the metal melt may also take up an interior space which is formed by a generatrix which rotates about a vertical tundish axis at a fluctuating, preferably harmonically pulsating distance (r) from the vertical tundish axis.

The melt is supplied below the metal bath level, in order not to disturb the slag-covered separation surface, and is guided in a defined way to the melt outlet.

The tundish according to the invention may also be operated in short-circuit mode, with the result that in particular the introduction of harmful particles from the tundish lining is kept at a low level. The term short-circuit mode is to be understood as meaning a procedure in which the metal melt which flows out of the casting ladle into the tundish or the interior space of a tundish flows through the latter over a short path and then flows back out of the outlet opening of the tundish or the interior space of the tundish. In this case, a flow profile in which a large proportion of the metal melt flowing in is not subject to any circulating flow within the tundish, but rather experiences only minor flow diversions on its substantially direct path from the melt inlet to the melt outlet, is established. This is achieved, in the method described, by virtue of the fact that the horizontal distance between the jet of metal melt which enters the melt volume substantially vertically and the jet of metal melt which emerges from the melt volume substantially vertically is set to less than half the base diameter of the interior space.

BRIEF DESCRIPTION OF THE DRAWINGS

Further advantages and features of the present invention will emerge from the following description of non-restricting exemplary embodiments, in which reference is made to the following figures, in which.

DESCRIPTION OF THE PREFERRED EMBODIMENTS

Figure 1:
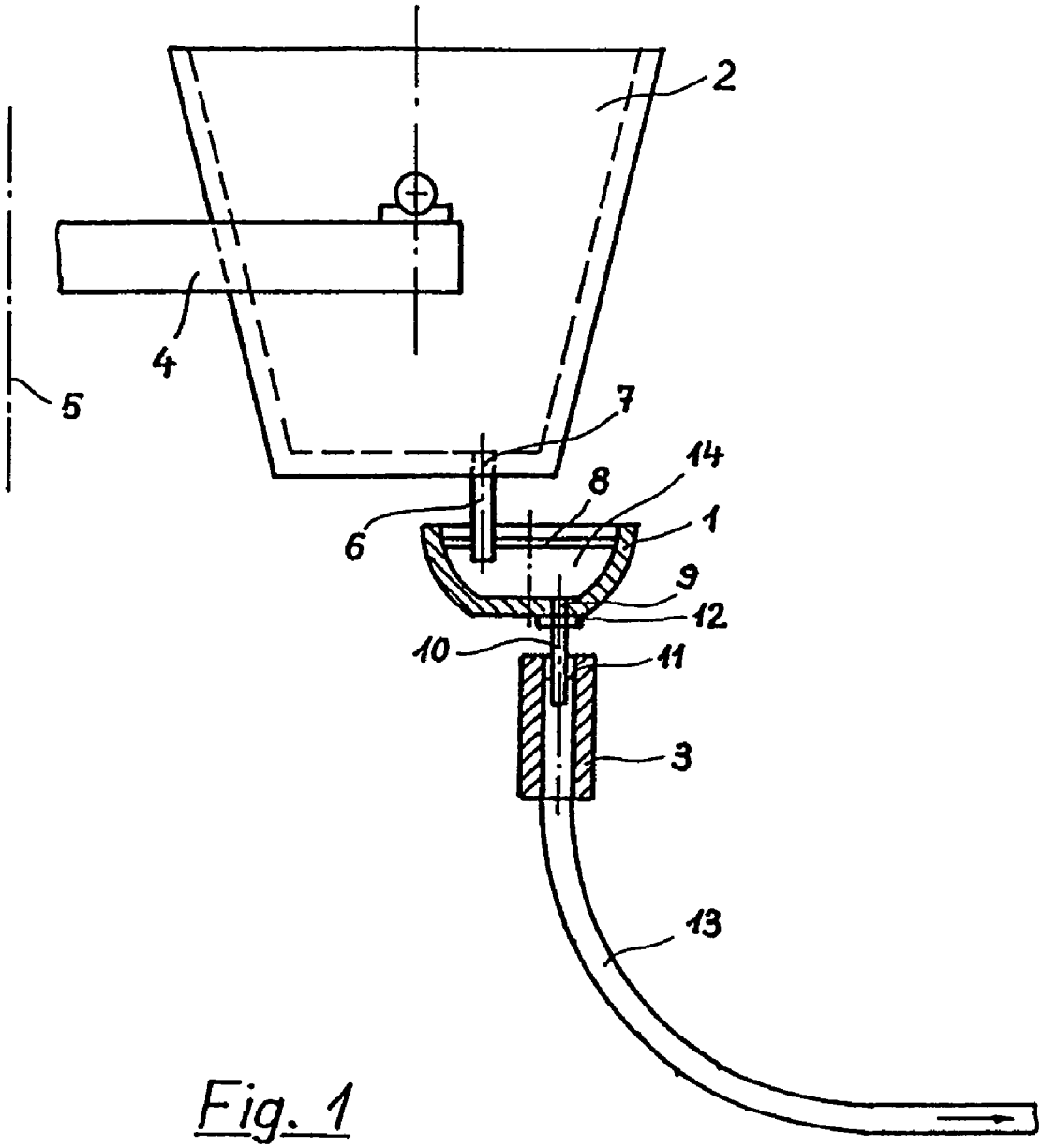
FIG. 1 diagrammatically depicts a continuous casting installation having the tundish according to the invention.

FIG. 1 diagrammatically depicts the arrangement of a tundish 1 according to the invention in its operating position between a casting ladle 2 and a permanent mold 3 in a continuous casting installation, which is indicated by the permanent mold 3 and the cast strand 13 conveyed out of it. The casting ladle 2 is fitted into forked arms 4 of a ladle turning tower, which is indicated by the vertical turning tower axis 5. Metal melt flows out of the casting ladle 2 into the tundish 1 through a submerged casting pipe 6, which adjoins the outlet opening 7 of the casting ladle 2 and projects into the tundish 1, and then emerges beneath the bath level 8. From there, the metal melt is transferred through an outlet opening 9 and a further submerged casting pipe 10 into the permanent mold 3, where it emerges below the permanent mold bath level 11. The flow of melt through the submerged casting pipe 10 is controlled by a controllable closure member 12, for example a slide. The metal melt solidifies in the cooled permanent mold 3 to form a cast strand 13 which is removed continuously in a roll guide (not shown) of a continuous casting installation.

Figure 2A:
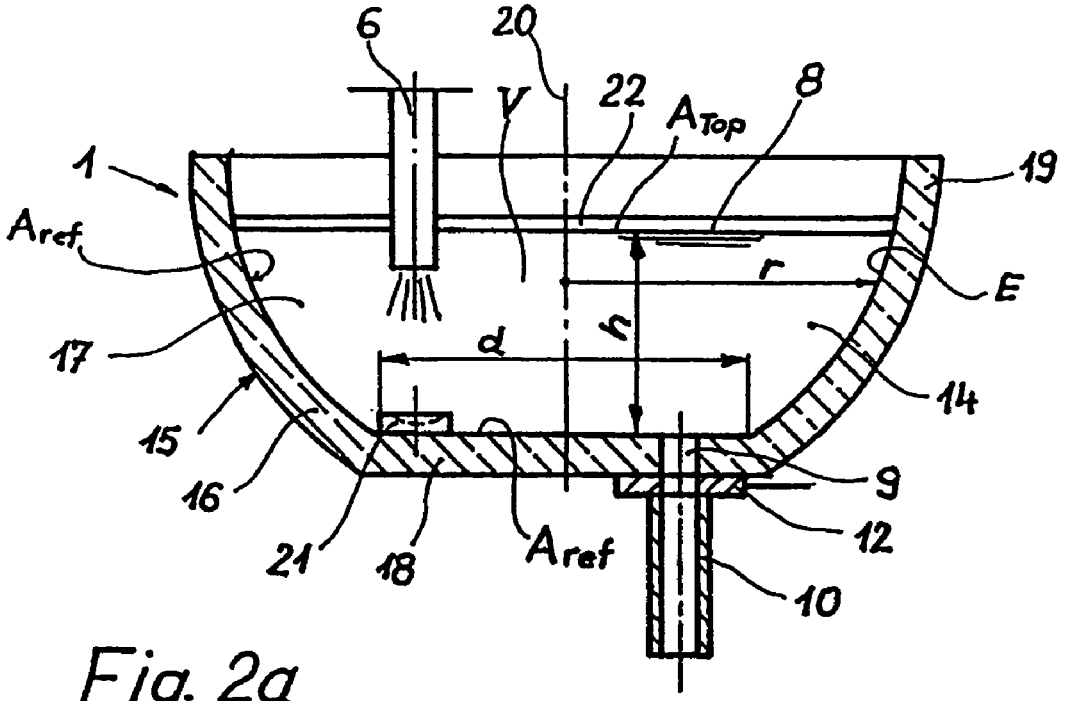
FIGS. 2*a*, 2*b* show the tundish according to the invention in the form of vertical and horizontal projections in accordance with a first embodiment.
Figure 2B:
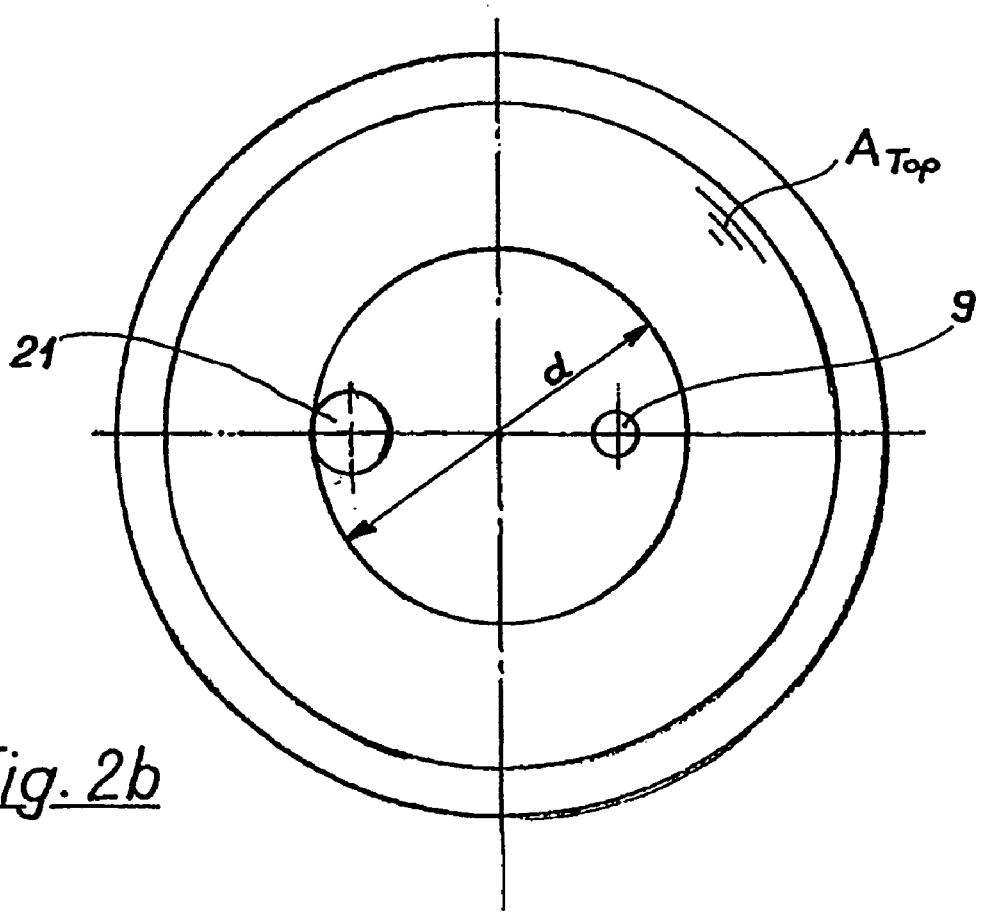

As shown in FIGS. 2*a* and 2*b*, the tundish 1 comprises a steel tank 15, which forms an outer, stable tundish frame, and a refractory lining 16 as an installation layer, the inner surface of which forms the contact surface with the metal melt 17 and shapes the interior space 14 of the tundish. The tundish wall 19 projects upward from the tundish base 18, rotationally symmetrically about a vertical tundish axis 20, and forms an interior space 14 in the form of a segment of a sphere. In geometric terms, the interior space 14 is formed by a generatrix E which rotates at a constant distance r about the vertical tundish axis 20. A flow diverter 21 is arranged beneath the submerged casting pipe 6, on the tundish base 18, at the maximum possible distance from the vertical tundish axis 20. At the opposite edge of the tundish base 18 there is an outlet opening 9, to which a closure member 12, designed as a controllable slide, and then a submerged casting pipe 10 are connected, secured to the steel tank 15 of the tundish. The flow diverter 21 and the outlet opening 9 are therefore at the maximum possible distance from one another.

A filling volume (V) in the interior space 14 of the tundish 1 is filled by the metal melt 17, with the exposed surface area ($A_{Top}$) of the metal melt forming the bath level 8, which is at operating bath level (h) and is covered by a slag layer 22, into which foreign particles are continuously separated out of the metal melt. In the tundish 1, a partial region of the surface area of the refractory lining 16 is wetted by metal melt 17, and this wetted refractory-lined surface area ($A_{ref}$) is exposed to particularly high thermal loads and chemical and mechanical erosion. Particles are continuously suspended from the refractory lining 16 into the metal melt 17 and discharged again to the slag layer 22 with the melt flow at the transition to this slag layer 22.

Figure 3A:
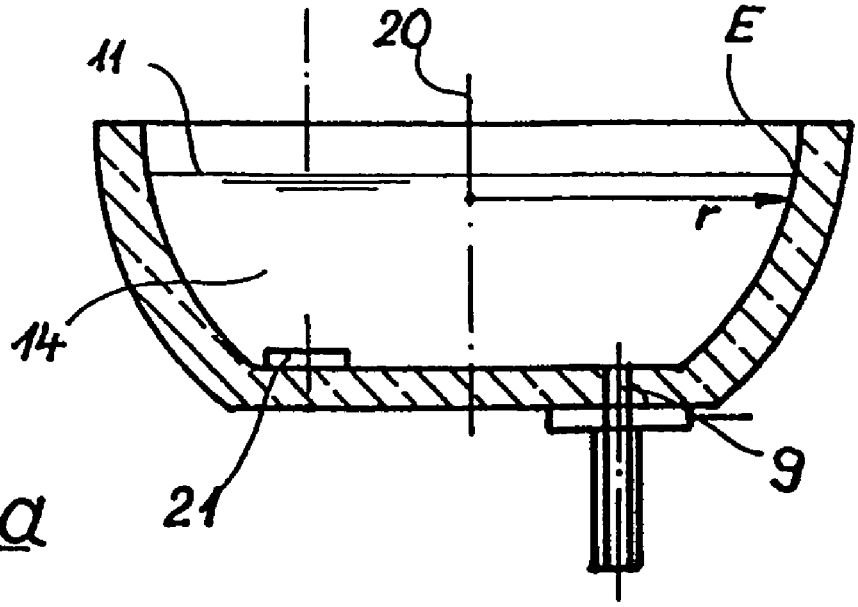
FIGS. 3*a*, 3*b* show the tundish according to the invention in the form of vertical and horizontal projections in accordance with a second embodiment.
Figure 3B:
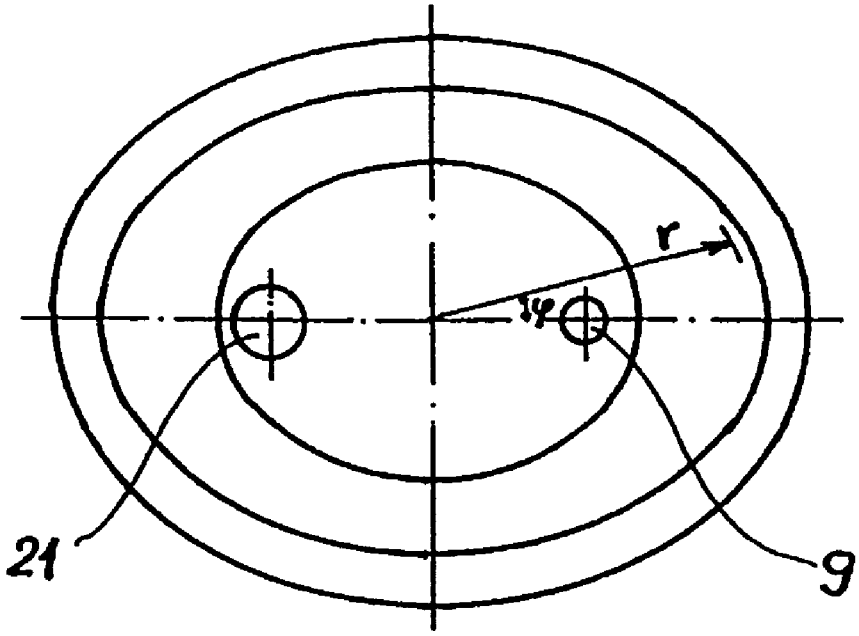

FIGS. 3*a* and 3*b* show a further embodiment of a possible tundish, in which each cross-sectional area taken normally to the vertical tundish axis 20 is formed by an ellipse, as can be seen from the horizontal projection. The inner contour results in geometric terms from rotation of a generatrix (E) about the vertical tundish axis 20, with the radius distance (r) between the generatrix and the vertical tundish axis varying as a function of the rotation angle (ϕ). In this case too, the flow diverter 21 and the outlet opening 9 are arranged as far as possible away from one another, in order to create favorable flow conditions in the interior space 14 and to ensure a high particle separation rate.

Figure 4A:
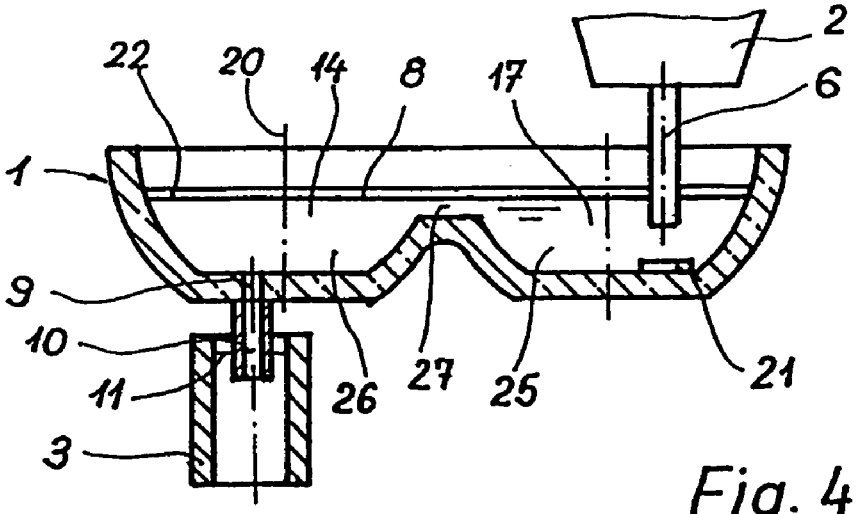
FIGS. 4*a*, 4*b* show the tundish according to the invention for a two-strand casting installation in the form of vertical and horizontal projections.
Figure 4B:
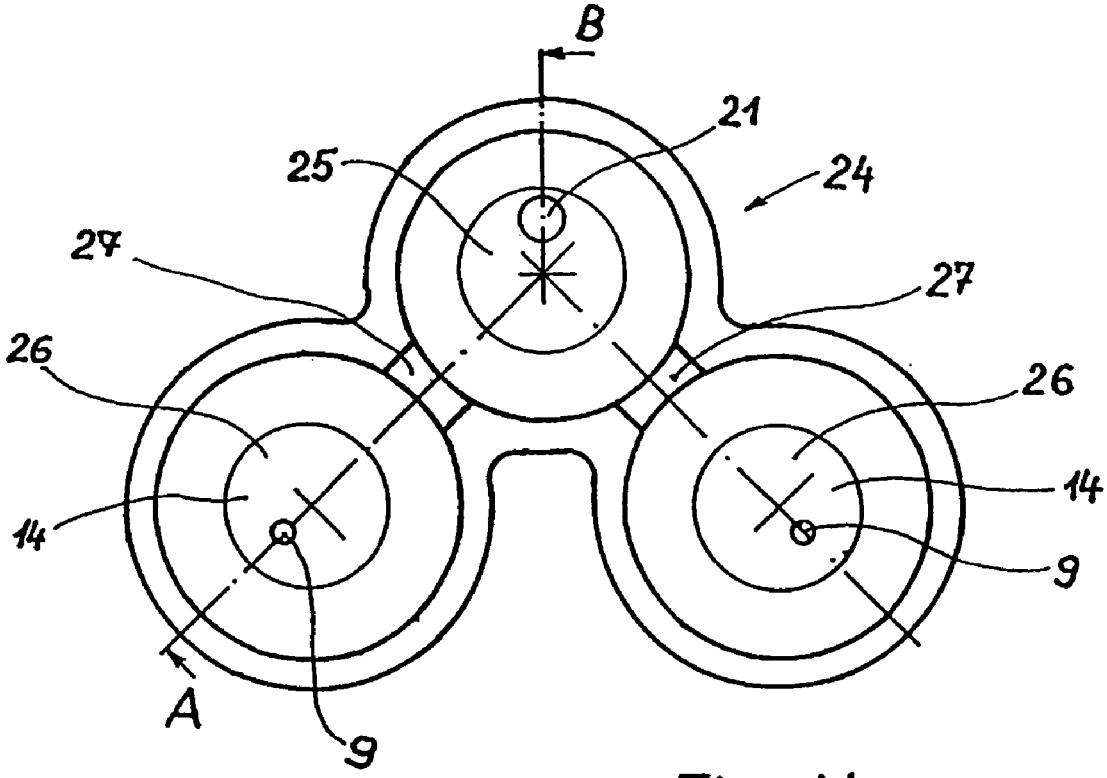

The tundish may also be formed by a plurality of holding tanks for metal melt. FIGS. 4*a* and 4*b* show vertical and horizontal projections of a tundish or distributor vessel for a two-strand casting installation, with the two strands 23 being indicated by dashed lines. The tundish, when seen in horizontal projection, is formed in a V shape by three connected holding tanks. A melt feed tank 25 is arranged centrally and connected to two melt discharge tanks 26 to form a structural unit.

A flow diverter 21 is incorporated in the base of the refractory lining in the melt feed tank 25. In this case, in a similar manner to that illustrated in FIG. 1, during operation the tundish is positioned in such a way that the submerged nozzle 6 of the casting ladle 2 is positioned precisely above the flow diverter 21. Each melt discharge tank 26 has an outlet opening 9 passing through it at the tundish base, the said outlet opening, during the casting operation, being positioned above the permanent mold 3. In this case, the submerged casting pipe 10 connected to the outlet opening 9 projects into the mold cavity of the permanent mold 3. The vertical section through the tundish on line A-B shows an overflow 27, formed by a refractory lining, between the melt feed tank 25 and the melt discharge tank 26. In this case, the bath level 8 of the metal melt 17 is above the overflow 27, and consequently the metal melt, which has undergone preliminary calming in the melt feed tank 25, can flow slowly into the melt discharge tank 26, where further particle separation can take place before the metal melt flows through the outlet opening 9 into the continuous casting mold 3. Both the melt feed tank 25 and the two melt discharge tanks 26 form an interior space 14 which is in the shape of a segment of a sphere.

Figure 5:
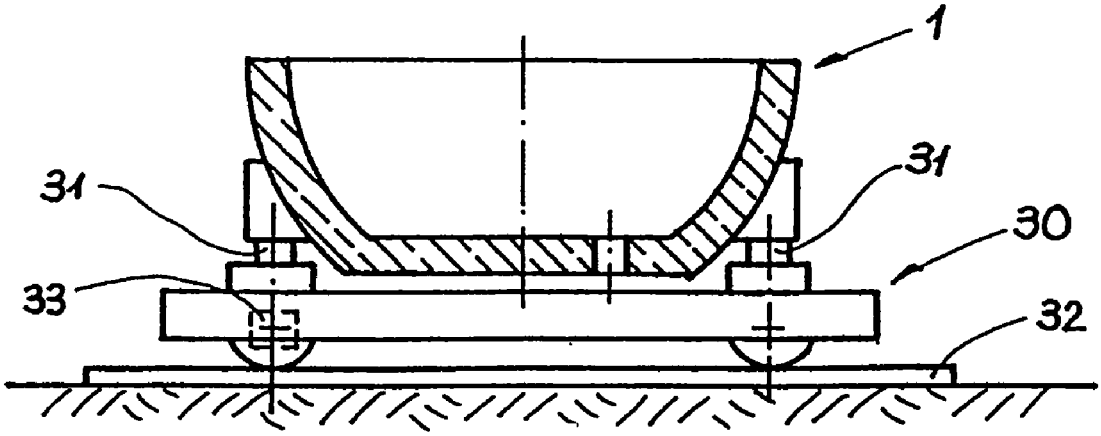
FIG. 5 shows the tundish according to the invention on a distributor carriage.

As is already customary for conventional continuous casting installations, the tundish according to the invention, in the same way as has previously been the case for the conventional tundishes, is supported on a distributor carriage 30 in such a manner that its height can be adjusted by means of lifting and/or tilting devices 31 and if appropriate also tiltably, and can be displaced, generally on rails along a movement path 32, between an operating position, in which the submerged casting pipe projects into the permanent mold, and a waiting position, in which the tundish is heated and prepared for its use (FIG. 5). The distributor carriage 30 is equipped with a movement drive 33.

The tundish is usually closed off by a cover in order to substantially avoid cooling of the melt through thermal radiation. If necessary, additional internal fittings in the tundish are possible, with a beneficial effect on the melt flow. The metal melt can also be transferred between the adjacent melt tanks below the bath level of the melts which have been introduced through one or more tubular transfer passages, which has the advantage of the slag layer only being exposed to very minor flow motion.

Figure 6:
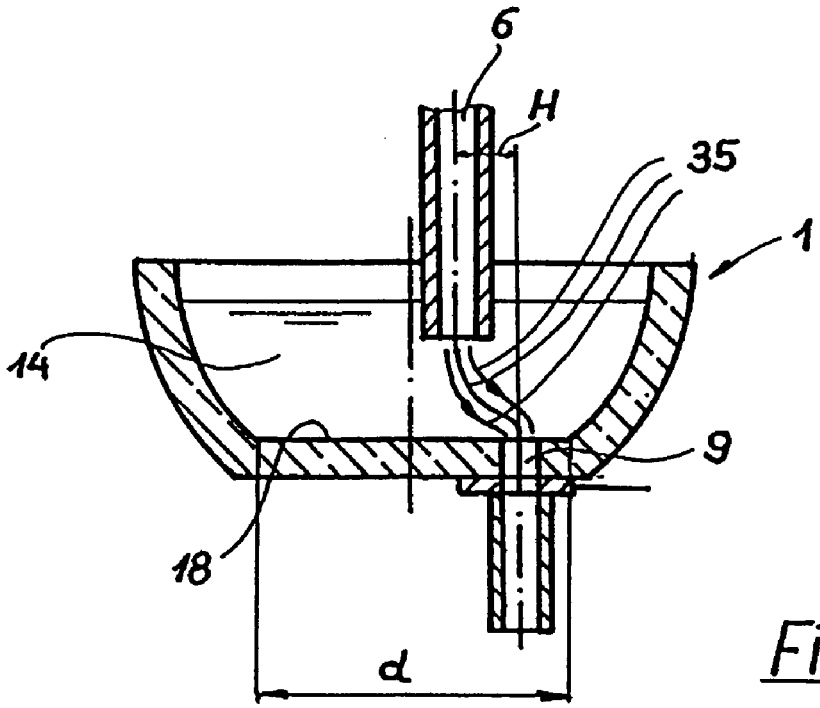
FIG. 6 shows the tundish according to the invention in short-circuit mode.

FIG. 6 illustrates the short-circuit mode which has already been described above with reference to the tundish. The metal melt flows into the tundish 1 through the submerged casting pipe 6 of the casting ladle into the interior space 14 and flows over a short path, indicated by flow lines 35, to the outlet opening 9, where it leaves the tundish again. The horizontal distance H between the metal melt which enters the interior space 14 in the vertical direction and the metal melt which leaves the interior space 14 again in the vertical direction is in this case less than half the diameter d of the tundish base 18.

The Invention claimed is:

1. A tundish for producing and transferring high-purity metal melt from a casting ladle into a permanent mold of a continuous-casting installation, the tundish having a refractory lining which defines a refractory-lined interior space of the tundish, the lining having a refractory-lined surface area which, as a function of an operating bath level (h), satisfies the condition that a dimensionless ratio (κ) of the refractory-lined surface area ($A_{ref}$) which is wetted by the metal melt to the filling volume (V) which is delimited by the refractory-lined surface area ($A_{ref}$) and the bath-level-dependent exposed surface area ($A_{Top}$) and results from a relationship $$\kappa = \frac{A_{ref}}{(V)^{\frac{2}{3}}}$$

be between 3.83 and 4.39.

2. The tundish as claimed in claim 1, wherein the dimensionless ratio (κ) is between 3.83 and 4.20.

3. The tundish as claimed in claim 1, wherein as a function of the operating bath level (h), the refractory-lined interior space of the tundish satisfies the condition that the ratio (ζ) of the exposed surface area ($A_{Top}$) to the refractory-lined surface area ($A_{ref}$) which is wetted by the metal melt is between 0.4 and 1.0.

4. The tundish as claimed in claim 3, wherein the ratio (ζ) is between 0.5 and 0.8.

5. The tundish as claimed in claim 1, wherein the operating bath level (h) in the tundish is between 0.5 m and 1.5 m.

6. The tundish as claimed in claim 1, wherein the filling volume (V) of the interior space of the tundish is at least 0.75 $m^3$.

7. The tundish as claimed in claim 1, wherein the filling volume (V) of the interior space of the tundish contains at least 5 times the quantity of metal melt which is cast each minute in normal operation.

8. The tundish as claimed in claim 1, wherein the refractory-lined interior space of the tundish is shaped as substantially formed by a generatrix which rotates about a vertical tundish axis.

9. The tundish as claimed in claim 1, wherein the refractory-lined interior space of the tundish is shaped as substantially formed by a generatrix which rotates about a vertical tundish axis at a distance (r) from a vertical tundish axis that varies as a function of the rotation angle of the generatrix.

10. The tundish as claimed in claim 1, wherein at least in sections thereof, the interior space of the tundish is in the shape of one of a hemisphere, a truncated cone, a paraboloid of revolution or a cylinder.

11. The tundish as claimed in claim 9, wherein the cross section of the interior space of the tundish, in a section plane taken normally to a vertical tundish axis, at least in sections, is circular or elliptical in form.

12. The tundish as claimed in claim 1, further comprising a submerged pipe which projects into the tundish to supply the melt there a flow diverter arranged on the tundish base and beneath the submerged pipe, an outlet opening arranged at a location of the tundish base which is spaced apart from the flow diverter by at least half the diameter (d) of the base.

13. The tundish as claimed in claim 1, further comprising a melt feed tank and at least one melt discharge tank, each melt discharge tank is separated from the melt feed tank, a transfer passage between the melt discharge and feed tanks, and each melt discharge tank delimits an interior space of the tundish.

14. The tundish as claimed in claim 13, wherein the melt feed tank delimits an interior space of the tundish.

15. The tundish as claimed in claim 13, further comprising a flow diverter in the melt feed tank and an outlet opening from the melt discharge tank.

16. The tundish as claimed in claim 1, further comprising a distributor carriage supporting the tundish, the carriage having at least one of a lifting device and a tilting device, and having a movement drive, the carriage being displaceable on a movement path between an operating position and a waiting position.

17. The tundish as claimed in claim 6, wherein the filling volume of the interior space is at least 1.0 $m^3$.

18. The tundish as claimed in claim 7, wherein the filling volume of the interior space contains at least 7 times quantity of melt.

19. The tundish as claimed in claim 9, wherein the distance (r) form the vertical axis is harmonically pulsating.

20. The turnish as claimed in claim 13, wherein the transfer passage is an overflow.

21. A process for producing a high-purity metal strand using a continuous casting installation, comprising passing metal melt from a casting ladle into a tundish and from the tundish into a continuous-casting permanent mold, setting a melt volume (V) of a metal melt contained in the refractory-lined interior space of a tundish, as a function of a respective operating bath level (h), such that a dimensionless ratio (κ) of the contact surface area ($A_{ref}$) formed by the metal melt to the melt volume (V) which is delimited by the contact surface area ($A_{ref}$) formed by the metal melt and the bath-level-dependent exposed surface area ($A_{Top}$) and which results from the relationship $$\kappa = \frac{A_{ref}}{(V)^{\frac{2}{3}}}$$

is between 3.83 and 4.39.

22. The process as claimed in claim 21, wherein the dimensionless ratio (κ) is between 3.83 and 4.2.

23. The process as claimed in claim 21, further comprising setting a melt volume (V) of the metal melt contained in the interior space such that a ratio (ζ) of the exposed surface area ($A_{Top}$) formed by the metal melt to the contact surface area ($A_{ref}$) formed by the metal melt is between 0.45 and 1.0.

24. The process as claimed in claim 23, wherein the ratio (ζ) is between 0.5 and 0.8.

25. The process as claimed in claim 21, further comprising setting the operating bath level (h) to between 0.5 m and 1.5 m.

26. The process as claimed in claim 21, further comprising setting the melt volume (V) to at least 0.75 $m^3$.

27. The process as claimed in claim 21, further comprising setting the melt volume (V) to at least 5 times the quantity of metal melt which is cast each minute during a normal operation of the process.

28. The process as claimed claim 21, wherein the metal melt substantially takes up an interior space formed by a generatrix (E) which rotates about a vertical tundish axis.

29. The process as claimed in claim 21, wherein the metal melt substantially takes up an interior space which is formed by a generatrix (E) which rotates about a vertical tundish axis at a fluctuating distance (r) from the vertical tundish axis that varies as a function of the rotation angle of the generatrix.

30. The process as claimed in claim 21, further comprising supplying the melt below a metal bath level and guiding the metal bath flow in a controlled manner to a melt outlet.

31. The process as claimed in claim 21, comprising setting a horizontal distance (H) between a jet of metal melt which enters the melt volume (V) substantially vertically and a jet of metal melt which exits from the melt volume (V) substantially vertically, the horizontal distance being set to less than half a base diameter (d) of the interior space.

32. The process as claimed in claim 26, wherein the melt volume is set to at least 1.0 $m^3$.

33. The process as claimed in claim 29, wherein the distance (r) from the vertical axis is harmonically pulsating.

34. The process as claimed in claim 27, wherein the melt volume is set to at least 7 times the quantity of the metal melt.

* * * * *

UNITED STATES PATENT AND TRADEMARK OFFICE

CERTIFICATE OF CORRECTION

PATENT NO. : 7,108,048 B2
APPLICATION NO. : 10/498797
DATED : September 19, 2006
INVENTOR(S) : Brummayer et al.

It is certified that error appears in the above-identified patent and that said Letters Patent is hereby corrected as shown below:

On title page
Item (75) Inventors should read:
Markus Brummayer, Aschach/Donau(AT); Gerald Eckerstorfer, Linz (AT); Gerald Hohenbichler, Kronstorf (AT); Heinz Hoedl, Leonding (AT); Karl Moerwald, St. Florian (AT)

Signed and Sealed this

Ninth Day of January, 2007

JON W. DUDAS
*Director of the United States Patent and Trademark Office*